US011446197B2

(12) United States Patent
Cortese

(10) Patent No.: US 11,446,197 B2
(45) Date of Patent: Sep. 20, 2022

(54) UNDERARM PILLOW

(71) Applicant: SHOULDER BUDDIES LLC, Naples, FL (US)

(72) Inventor: Dianne Cortese, Naples, FL (US)

(73) Assignee: SHOULDER BUDDIES LLC, Naples, FL (US)

( * ) Notice: Subject to any disclaimer, the term of this patent is extended or adjusted under 35 U.S.C. 154(b) by 268 days.

(21) Appl. No.: 16/917,007

(22) Filed: Jun. 30, 2020

(65) Prior Publication Data

US 2021/0000672 A1 Jan. 7, 2021

Related U.S. Application Data

(60) Provisional application No. 62/869,734, filed on Jul. 2, 2019.

(51) Int. Cl.

| | |
|---|---|
| ***A61G 13/12*** | (2006.01) |
| ***A47C 20/02*** | (2006.01) |
| ***A61G 13/00*** | (2006.01) |

(52) U.S. Cl.

CPC ..... *A61G 13/1235* (2013.01); *A47C 20/023* (2013.01); *A61G 13/009* (2013.01)

(58) Field of Classification Search

CPC .. A61G 13/12; A61G 13/1235; A61G 13/009; A47C 20/00; A47C 20/023

See application file for complete search history.

(56) References Cited

U.S. PATENT DOCUMENTS

| | | | | |
|---|---|---|---|---|
| 4,550,725 | A | 11/1985 | Wishman | |
| 2008/0052834 | A1* | 3/2008 | Hill | A61G 13/12 5/655.9 |
| 2008/0301878 | A1* | 12/2008 | Elhabashy | A61G 13/12 5/646 |
| 2011/0213282 | A1 | 9/2011 | Cortese | |

OTHER PUBLICATIONS

Sharkey, Neil A., and Richard A. Marder. "The rotator cuff opposes superior translation of the humeral head." The American journal of sports medicine23.3 (1995): 270-275, abstract only, https://doi.org/10.1177/036354659502300303.

Aras, Meltem Dalyan, et al. "Shoulder pain in hemiplegia: results from a national rehabilitation hospital in Turkey." American journal of physical medicine & rehabilitation83.9 (2004): 713-719, abstract only, DOI: 10.1097/01.PHM.0000138739.18844.88.

Fessa, Chris Kon, et al. "Posterosuperior glenoid internal impingement of the shoulder in the overhead athlete: pathogenesis, clinical features and MR imaging findings." Journal of Medical Imaging and Radiation Oncology59.2 (2015): 182-187., DOI: 10.1111/1754-9485.12276.

(Continued)

*Primary Examiner* — Fredrick C Conley

(74) *Attorney, Agent, or Firm* — Hahn Loeser & Parks LLP

(57) ABSTRACT

An underarm pillow for the relief of human shoulder discomfort is formed from a block of compressible visco-elastic foam shaped to fit under the armpit with a concave upward surface which both supports the weight of the arm and also supplies horizontal forces on the ball of the humerus to locate the ball properly in the socket of the shoulder.

17 Claims, 1 Drawing Sheet

(56) References Cited

OTHER PUBLICATIONS

Hawthorne, Jacqueline R., et al. "Effects of abduction pillows on rotator cuff repair: a biomechanical analysis." HSS Journal®14.2 (2018): 114-122., https://doi.org/10.1007/s11420-017-9592-2.

Lefvre-Colau, Marie-Martine, et al. "Kinematic patterns in normal and degenerative shoulders. Part II: Review of 3-D scapular kinematic patterns in patients with shoulder pain, and clinical implications." Annals of Physical and Rehabilitation Medicine61.1 (2018): 46-53.

Danzinger, Victor, Eva Schulz, and Philipp Moroder. "Epidemiology of functional shoulder instability: an online survey." BMC Musculoskeletal Disorders20.1 (2019): 1-5., https://doi.org/10.1186/s12891-019-2563-7.

* cited by examiner

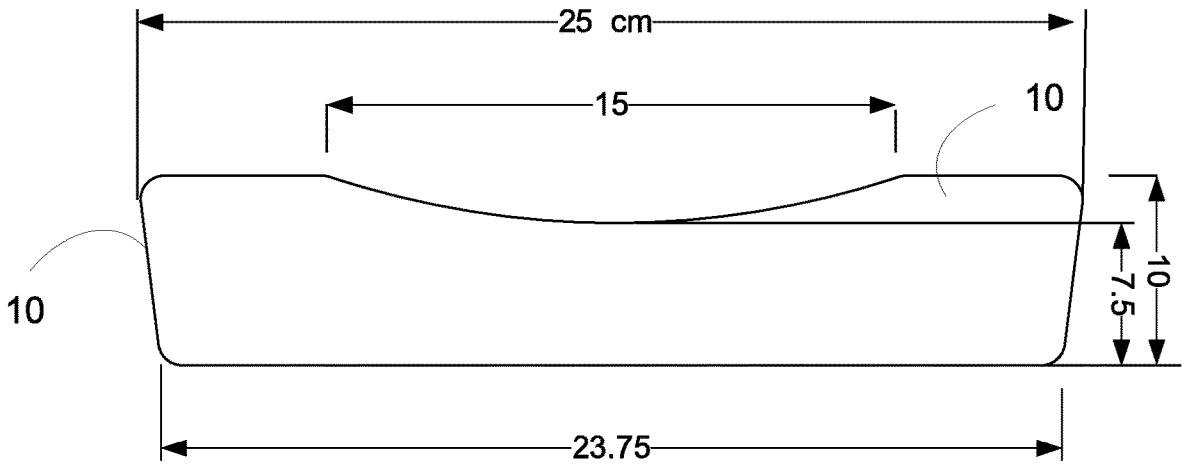
Fig. 1
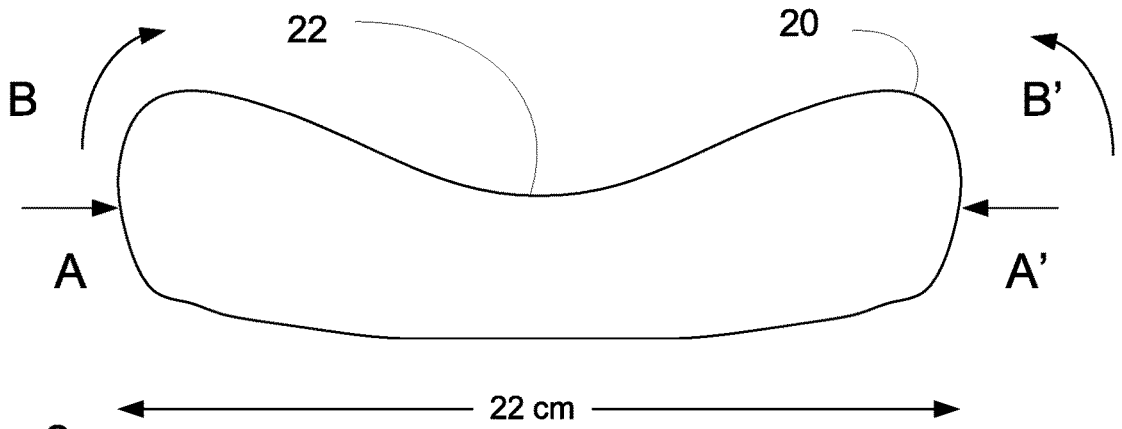
Fig. 2
Fig. 3
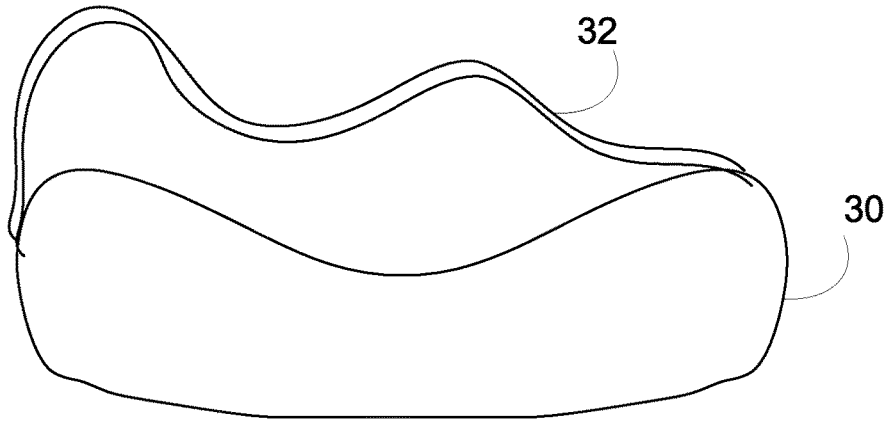

UNDERARM PILLOW

CROSS REFERENCE TO RELATED APPLICATIONS

This application claims priority pursuant to 35 U.S.C. 119(e) to U.S. Provisional Application 62/869,734, filed Jul. 2, 2019, by Dianne Cortese, which is hereby incorporated herein by reference in its entirety, including incorporated material.

FIELD OF THE INVENTION

The field of the invention is the field of therapeutic support structures for the human body.

BACKGROUND OF THE INVENTION

It is well known that the upright posture of humans leads to mechanical problems with the skeleton and structures of the human body as humans have evolved towards a bipedal future. Physiotherapists have long used rolled or folded towels placed between the body and the upper arm to hold the upper arm and forearm away from the body so that the upper arm makes a greater angle with the vertical force of gravity than the arm would have if it were hanging normally with the head of the humerus rotating in the shallow glenoid in the shoulder. Such an arm position is beneficial to reduce pain in cases, for example, when the rotator cuff structure of the shoulder is injured, strained, or just tired. The rolled up towel has been used by physiotherapists for exercise of the shoulder to help stabilize the glenohumeral joint.

OBJECTS OF THE INVENTION

It is an object of the invention to produce an improved method and device to support the shoulder of a human being.

SUMMARY OF THE INVENTION

A pillow is described which has a concave upward surface contacting and supporting the axilla. The pillow is constructed of an appropriately shaped block of uniform resilient foam material which is compressed non uniformly to provide appropriately directed forces on the axilla.

BRIEF DESCRIPTION OF THE DRAWINGS

FIG. 1 shows dimensions and structure of the cut out uncompressed block of foam material of the invention.

FIG. 2 shows the dimensions of the compressed and deformed block of the invention. The material in the block is compressed along the line A-A' and rotated by torque applied as shown by B and B'.

FIG. 3 shows the compressed and deformed block of the invention enclosed in a closable fabric container or cover.

DETAILED DESCRIPTION OF THE INVENTION

Disclosed is an underarm pillow for placing below and in upward contact with the armpit (axilla) of a human person to relieve pain of tired, strained or torn muscles, to rest strained muscles, or to provide comfort to persons if the position of the tired or injured upper arm depending from the shoulder structure creates strain, subluxation, or unfavorable joint position. The correctly placed underarm pillow provides forces on the axilla which, when transmitted to the head of the humerus provide extra support to the rotator cuff muscles, which hold the head of the humerus tightly against the socket and allow the ball to rotate in the socket without relative motion in the plane of contact area between the head and the socket. The underarm pillow aids and assists contact of the humeral head and the glenoid socket of the scapula known as the GH joint. The GH joint is kept intact by the ligaments, labrum, and rotator cuff muscles of the shoulder. The underarm pillow assists a healthy joint position when there is laxity, injury, or fatigue in any of the shoulder parts.

The inventor is an experienced physiotherapist, and has experimented with using various foams and shapes as pillows to position the upper arm correctly. The inventor has experimented with various shapes of uniform foam, and found, in essence, that manipulating a correctly shaped piece of uniform foam material by compressing and bending it by hand it to a determined shape gives improved results over a foam shape carved from a block of uniform foam. The inventor has determined that foam material with desirable non uniform compression and tension can be achieved by enclosing the foam in a closable fabric container of a determined shape which can mimic the hands of the therapist.

The glenohumeral joint (ball and socket joint of the shoulder) is very prone to injury. The rotator cuff muscles are attached to the head of the humerus and are used to hold the head firmly in contact with the socket with a force that has enough of a component perpendicular to the contact surface between head and the socket that the head does not slide parallel to the contact surface, but can roll on the surface of the socket When the rotator cuff muscles and tendons are too tired, weak, or damaged to hold the head of the humerus firmly enough in the correct place in the socket (glenoid fossa) of the scapula, pain and shoulder instability results. Impingement syndrome, shoulder rotator cuff tear/strain, labrum tear, shoulder subluxations, and nerve damage from a stroke are common causes of shoulder pain.

The Shoulderbuddy® product of the invention is a compressed memory foam product that, when placed correctly in the human axilla (armpit) provides an upward force on the bottom of the armpit to help the rotator cuff muscles support the head of the humerus in the glenoid. The concave body of the Shoulderbuddy® cradles and provides further horizontal support forces to prevent the head from sliding toward the back or front of the body.

The normal action of the rotator cuff muscles is to stabilize the rotator cuff and The Deltoid muscle arrows would be driving the humeral head superiorly. When the rotator cuff is not working properly (due to fatigue or injury) the humeral head contact area is not able to stay in the correct part of the socket as the head rotates leading to overuse type injuries as mentioned above.

When the Shoulderbuddy® is in place the rotator cuff can recover because the Shoulderbuddy® is taking part of the load off the rotator cuff muscles. The position of the correctly shaped support structure in the axilla assists the compression of the humeral head into a healthy position in the socket.

In addition the Shoulderbuddy® placed in position in the axilla causes the upper arm to rotate away from the body at a slight angle of 20-30 degrees, which has also been shown to help the compression of the humeral head in the socket (which gives it more stabilization). Immediate pain relief is often experienced followed by more rapid recovery of tired or damaged muscles.

Memory foam consists mainly of polyurethane foam as well as additional chemicals increasing its viscosity and density. It is often referred to as "viscoelastic" polyurethane foam, or low-resilience polyurethane foam (LRPu). The foam bubbles or 'cells' are open, effectively creating a matrix through which air can move. Higher-density memory foam softens in reaction to body heat, allowing it to mold to a warm body in a few minutes. Newer foams may recover more quickly to their original shape, a property defined as resilience. The inventor has determined that such foams are suited to the purpose of underarm pillows.

Sheets of foam are manufactured, principally for mattresses, in various thicknesses. For mattresses, two or more sheets may be joined to give different resilience to the mattresses.

FIG. 1. Shows a sketch of a block of foam 10 cut from a two inch thick material having uniform density, resilience, and other properties which are thus uniform through the entire block. The dimensions shown are in cm. Tests have shown that the actual dimensions are effective with a 25% variation, but the best results are with the dimensions shown.

FIG. 2 shows a sketch of the invention wherein the block 10 shown in FIG. 1 is compressed to a shape 20. The shape 20 is compressed as along the line A-A' and rotated by torques applied as shown by B and B'. When the material is manipulated in the hands of a skilled physiotherapist to achieve relief of pain and discomfort, the patient reports nearly instant relief of symptoms as the block is squeezed with pressure and torque as shown. The dimensions of the block are changed by the pressure and tension placed on the block, and the foam density is changed as a function of position in the block.

In order to hold the block in the correct shape, a closable fabric container, or cover 30, is used wherein the material of the fabric is much less elastic than the material of the block, and the volume of the closed fabric container is significantly smaller than the volume of the block. When the block 10 is stuffed into the container 30, the block deforms and the container into a different shape to approximate the shape shown in FIG. 3, and when the enclosed fabric covered deformed block is placed under the armpit of a patient, is deforms once again as the hanging forearm and upper arm are pulled by gravity to make the block compress in thickness.

An optional strap 32 is show attached to the cover 30. The strap 30 may pass over the top of the shoulder or around the upper arm. The strap may be elastic or have adjustable length The inventor anticipates that the pillow of the invention may be constructed by using different foam materials having different properties to mimic the properties of the stressed and strained foam of the invention. Multilayers of foam may be used, and different parts of the pillow may be constructed and joined in a manner known to one skilled in the art of foam construction. The fabric cover could then be merely a washable removable cover having no function to change the distribution of material properties of the pillow.

The appendices appended to this disclosure are hereby incorporated by reference in their entirely, including included references.

Obviously, many modifications and variations of the present invention are possible in light of the above teachings. It is therefore to be understood that, within the scope of the appended claims, the invention may be practiced otherwise than as specifically described.

I claim:

1. A method for supporting a shoulder structure by placing an underarm pillow in an axilla, the method comprising the steps of:

deforming and maintaining a block of compressible viscoelastic material in a compressed arrangement to produce non-uniform physical properties on the block of compressible viscoelastic material;

inserting the compressed arrangement of the block of compressible viscoelastic material into a cover wherein the cover further maintains the block of compressible viscoelastic material in the compressed arrangement; and positioning the deformed block of compressible viscoelastic material in the axilla where the deformed block of compressible viscoelastic material supports the shoulder structure.

2. The method of claim 1 wherein the block of compressible viscoelastic material is a uniform block of viscoelastic material before being deformed and maintained in the compressed arrangement.

3. The method of claim 1 wherein the block of compressible viscoelastic material comprises a concave surface and the concave surface is positioned within the axilla in the step of positioning further to cradle the shoulder structure.

4. The method of claim 1 further comprising the step of:

extending a strap attached to the cover around an upper arm or around a humerus to maintain the block at the axilla.

5. The method of claim 1 further comprising the step of:

utilizing a strap attached to the cover to maintain the block at the axilla wherein the strap is elastic or has an adjustable length for positioning the strap at different locations on a body.

6. An underarm pillow placed in an axilla for supporting a shoulder structure, the underarm pillow comprising:

a block of compressible viscoelastic material, the block having a length, a width, a height, and a volume in an uncompressed arrangement where the block of compressible viscoelastic material is maintained in a compressed arrangement having non-uniform physical properties; and a cover wherein the cover comprises a material that is less elastic than the block of compressible viscoelastic material and the block of compressible viscoelastic material is positioned within the cover to maintain the block of compressible viscoelastic material in compressed arrangement and wherein the cover is removable from the block of compressible viscoelastic material.

7. The underarm pillow of claim 6 wherein the block of compressible viscoelastic material is a uniform block of compressible viscoelastic material in the uncompressed arrangement.

8. The underarm pillow of claim 6 wherein the block of compressible viscoelastic material further comprises a concave surface for cradling the axilla and supporting the shoulder structure.

9. The underarm pillow of claim 6 wherein the cover further comprises a strap for securing the underarm pillow to the axilla.

10. The underarm pillow of claim 6 wherein the volume of the uncompressed arrangement of the block is larger than a volume inside the cover.

11. The underarm pillow of claim 6 wherein the block of compressible viscoelastic material positioned within the cover is deformed within the cover.

12. The underarm pillow of claim 6 wherein a length of the cover is less than the length of the block and the length of the block positioned within the cover is compressed to the length of the cover.

13. The underarm pillow of claim 6 wherein the cover is a fabric cover that completely encloses the block.

14. The underarm pillow of claim 6 wherein the non-uniform physical properties of the block of compressible viscoelastic material are adjustable based upon a position of the block of compressible viscoelastic material within the cover.

15. The underarm pillow of claim 6 wherein the cover completely encloses and compresses the block and wherein a volume of the block in the compressed arrangement within the cover is at least 20 percent less than the volume of the block in the uncompressed arrangement.

16. A method for supporting a shoulder structure by placing an underarm pillow in an axilla, the method comprising the steps of:

deforming and maintaining a block of compressible viscoelastic material in a compressed arrangement to produce non-uniform physical properties on the block of compressible viscoelastic material;

positioning the deformed block of compressible viscoelastic material in the axilla where the deformed block of compressible viscoelastic material supports the shoulder structure; and further compressing the compressed arrangement with an upper arm extending from the axilla while the block of compressible viscoelastic material supports the upper arm and displaces the upper arm from a torso, also extending from the axilla, at an angle of between 20 to 30 degrees.

17. A method for supporting a shoulder structure by placing an underarm pillow in an axilla, the method comprising the steps of:

deforming and maintaining a block of compressible viscoelastic material in a compressed arrangement to produce non-uniform physical properties on the block of compressible viscoelastic material;

positioning the deformed block of compressible viscoelastic material in the axilla where the deformed block of compressible viscoelastic material supports the shoulder structure; and further compressing the compressed arrangement with an upper arm extending from the axilla while the block of compressible viscoelastic material supports the upper arm and displaces the upper arm from a torso, also extending from the axilla, at an angle of between 10 to 25 degrees.

* * * * *